US008220102B2

(12) United States Patent
Clos et al.

(10) Patent No.: US 8,220,102 B2
(45) Date of Patent: Jul. 17, 2012

(54) TOOTHBRUSH

(75) Inventors: Thomas Clos, Neustadt (DE); Hans Kraemer, Buehl (DE)

(73) Assignee: GlaxoSmithKline Consumer Healthcare GmbH & Co. KG, Buehl (Baden) (DE)

( * ) Notice: Subject to any disclaimer, the term of this patent is extended or adjusted under 35 U.S.C. 154(b) by 976 days.

(21) Appl. No.: 10/591,823

(22) PCT Filed: Mar. 7, 2005

(86) PCT No.: PCT/EP2005/002471

§ 371 (c)(1),
(2), (4) Date: Jul. 18, 2007

(87) PCT Pub. No.: WO2005/084486

PCT Pub. Date: Sep. 15, 2005

(65) Prior Publication Data

US 2007/0271717 A1 Nov. 29, 2007

(30) Foreign Application Priority Data

Mar. 9, 2004 (GB) ..... 0405314.6
May 14, 2004 (GB) ..... 0410840.3

(51) Int. Cl.
*A46B 3/20* (2006.01)
*A46B 7/06* (2006.01)
*A46B 9/04* (2006.01)

(52) U.S. Cl. ..... 15/167.1; 15/201

(58) Field of Classification Search ..... 15/167.1, 15/201

See application file for complete search history.

(56) References Cited

U.S. PATENT DOCUMENTS

| | | | | |
|---|---|---|---|---|
| 2,706,825 | A | 4/1955 | Blakeman | |
| 4,633,542 | A | 1/1987 | Taravel | |
| 5,355,546 | A | 10/1994 | Scheier et al. | |
| 5,362,834 | A | 11/1994 | Schnaepel et al. | |
| 5,373,602 | A | 12/1994 | Bang | |
| 5,454,133 | A | 10/1995 | Garnet | |
| 5,456,642 | A | 10/1995 | Frost | |
| 5,483,722 | A * | 1/1996 | Scheier et al. | 15/167.2 |
| 5,488,722 | A | 1/1996 | Scheier et al. | |
| 5,970,564 | A | 10/1999 | Inns et al. | |
| 6,006,395 | A * | 12/1999 | Tiramani et al. | 15/176.1 |
| 6,036,277 | A | 3/2000 | Weihrauch et al. | |
| 6,141,817 | A * | 11/2000 | Dawson | 15/167.1 |
| 6,327,735 | B1 | 12/2001 | Krämer | |
| 8,069,524 | B2 | 12/2011 | Kraemer | |
| 8,099,819 | B2 | 1/2012 | Kraemer | |
| 2002/0123562 | A1 | 9/2002 | Stender et al. | |
| 2004/0025275 | A1 * | 2/2004 | Moskovich et al. | 15/167.1 |

(Continued)

FOREIGN PATENT DOCUMENTS

DE 4122524 * 2/1992

(Continued)

*Primary Examiner* — Mark Spisich
(74) *Attorney, Agent, or Firm* — Joshua C. Sanders; Nora L. Stein; Theodore R. Furman

(57) ABSTRACT

A toothbrush head comprising a flexible bristle carrier such as an elastomer or gel pad or flexibly linked segments, on which bristles are mounted, with a support which supports the carrier at its base near the handle and at the opposite tip part, leaving the carrier unsupported thereby in a region longitudinally between these parts, the carrier being flexible such that it can deform under the forces of toothbrushing so that both its longitudinal and widthways sections become distorted. Preferably the support is also flexible.

16 Claims, 6 Drawing Sheets

U.S. PATENT DOCUMENTS

| | | | |
|---|---|---|---|
| 2005/0188487 | A1 | 9/2005 | Moskovich et al. |

FOREIGN PATENT DOCUMENTS

| | | | | |
|---|---|---|---|---|
| DE | 20120773 | | | 4/2002 |
| DE | 20109123 | U1 | | 10/2002 |
| EP | 0142885 | | | 11/1984 |
| EP | 0336641 | | | 3/1989 |
| EP | 0923326 | B1 | | 6/2003 |
| EP | 1593321 | | | 11/2005 |
| JP | 2001-25411 | | * | 1/2001 |
| WO | WO 92/17092 | | | 10/1992 |
| WO | WO 92/17093 | | | 10/1992 |
| WO | WO 93/24034 | | | 12/1993 |
| WO | WO 96/02165 | | | 2/1996 |
| WO | WO 97/07707 | | | 3/1997 |
| WO | WO 97/24949 | | | 7/1997 |
| WO | WO 98/35584 | | | 8/1998 |
| WO | WO 98/37788 | | | 9/1998 |
| WO | WO 98/43514 | | | 10/1998 |
| WO | WO98/43514 | A | | 10/1998 |
| WO | WO00/40115 | | | 7/2000 |
| WO | WO 00/60980 | | | 10/2000 |
| WO | WO03/001942 | | | 1/2003 |
| WO | WO03/001943 | | | 1/2003 |
| WO | WO2004/014181 | A | | 2/2004 |
| WO | WO2004/080238 | A | | 9/2004 |
| WO | WO2005/013762 | A | | 2/2005 |

* cited by examiner

-W
B
13
15
14
12
110
111
19

-L
W-
18
12
10
19
W
13
15
16
17
11
L-

-L
18
12B
16
13
15
B
12
14
110
111
12C
17
12A
11
L-

24
20
21B
111
19
-A
20
24
21A
21B
23
21D
21C
22
A-
11

24
111
21A
22
21D
20
19
16
11

TOOTHBRUSH

This application is a §371 national phase entry of International Application No. PCT/EP2005/002471, filed Mar. 7, 2005.

This invention relates to toothbrushes, in particular to toothbrushes having flexibly mounted bristles.

Typically a toothbrush comprises a head and a grip handle disposed along a head-handle longitudinal direction, optionally with a neck longitudinally between the head and handle. Typically the head is elongate in line with this longitudinal direction, and has a tip end longitudinally remote from the handle, and a longitudinally opposite base end closest to the handle. Typically the head has a surface from which bristles extend, the "bristle face", in a bristle direction transverse to, typically generally perpendicular, to the longitudinal direction and an opposite back face. Typically the head has a width direction transverse to, typically generally, perpendicular to both the longitudinal and bristle directions.

It is generally known to make the head flexible so that the head can respond to pressures applied to the bristles by resilient flexible deformation to cushion excess brushing pressures and to allow the bristles to accommodate themselves to the profiles of the teeth. For example DE-U-201 09 123 discloses a toothbrush head having bristles mounted in plural longitudinally arranged plastics material segments flexibly linked together, and mounted across the concavity of a supporting "bow". JP-A-13025411 discloses a toothbrush head with bristles mounted on a flexible plate across a concave backing and passing through holes in a guide plate.

Various toothbrushes are known in which the bristles, usually in tufts, are mounted in a flexible bristle carrier. For example U.S. Pat. No. 2,706,825 discloses a toothbrush with a concavely curved head the two longitudinally disposed ends of which support a demountable bristle carrier which bridges the curve and is made of elastic material. For example U.S. Pat. No. 5,373,602 discloses a toothbrush in which the ends of the bristles are set in a rubbery flexible tip extension to the head.

Various ways are known whereby the ends of toothbrush bristles may be fixed in an elastomer bristle carrier. For example WO-A-98/35584 discloses a toothbrush head in which the bristle ends are mounted in rigid wells set in an elastomer material. WO-A-98/43514 discloses a toothbrush head in which bristles in tufts are mounted in cup-like holders embedded in a soft elastic material. WO-A-00/60980 discloses a toothbrush head in which bristles in tufts have their ends linked by a web which is embedded in a soft elastic material. WO-A-05013762, the contents of which are incorporated herein by reference, discloses a toothbrush head which incorporates a mass of a gel material, preferably being a polyurethane gel, and bristle ends are embedded in the mass, also disclosing a toothbrush head having comprising a frame of a hard plastics material by which the mass is supported. A good bond is formed between such polyurethanes and the polyamide materials of which toothbrush bristles are generally made.

WO-A-04/020238 discloses a toothbrush head in which bristles in tufts have their ends fused into a thickened mass and embedded in an elastomer bristle carrier, and are threaded through plastics material rings embedded in the elastomer pad.

Such toothbrush heads in the state of the art are not optimised because the directions in which the flexibly mounted bristles in the head can flexibly move is limited, consequently the adaptation of the bristles to the shape of the teeth is also limited.

It is an object of this invention to provide a toothbrush in which the bristles are flexibly mounted onto the head which overcomes at least in part the problems encountered with the above-mentioned toothbrushes of the state of the art, and also to provided alternative constructions of toothbrush head.

Other objects and advantages of the present invention will be apparent from the following description.

According to a first aspect of this invention a toothbrush head, connected to or connectable to a toothbrush grip handle to define a head-handle length direction and a width direction perpendicular to the longitudinal direction is provided, comprising a flexible bristle carrier on which bristles are mounted and having a base part closest to the toothbrush handle when connected and a longitudinally opposite tip part, and a support which supports the carrier;

characterised in that the support supports the carrier at the base part and at the tip part, leaving the carrier unsupported thereby in a region longitudinally between these parts, the carrier being flexible such that it can deform under the forces of toothbrushing so that both its longitudinal and widthways sections become distorted.

The bristles may be made of a conventional bristle material e.g. a polyamide material e.g. nylons such as Tynex™ (DuPont) abovementioned, or polyester. For example nylon monofilaments such as those commercially available from DuPont under the name DuPont Tynex, made from Nylon 512 may be used. Typically the bristles are grouped in tufts containing plural bristles, as conventionally.

Typically bristles may be disposed in tufts containing conventional numbers of bristles and of generally conventional shapes and dimensions. For example tufts may contain 5-100, preferably 10-75, e.g. 30-60 bristles per tuft. Such tufts may for example be of circular or non-circular e.g. longitudinally or widthways elongated cross section, and may have a typical dimension across their length of 0.75-5 mm. Circular sectioned tufts typically have a diameter ca. 0.9-1.5 mm, and may have their ends proximate to the head embedded in the mass of elastomer material to a depth of 0.5-5 mm, typically ca. 0.7-1.5 mm, for example so that the proximate ends are disposed part way through the thickness of the mass from the bristle surface. Alternatively bristles may be embedded individually rather than plurally in tufts.

In one embodiment the flexible bristle carrier may comprise a pad of an elastic material. This may be an elastomer material, preferably a thermoplastic elastomer material ("TPE"), as such materials can easily be injection moulded and bind with most of the plastics materials used for toothbrush construction. Many such TPE materials are known for use in toothbrushes. A preferred elastomer material has a hardness Shore A 10-40, preferably 20+/−10, more preferably 20+/−5. Some suitable materials are for example those available from Kraiburg Gummiwerk (DE) under the reference numbers RTF 8778, 8728, 8722 and 8725. The pad may have a thickness, i.e. its dimension in the bristle direction, of for example 2.5 to 5 mm, typically 3+/−0.5 mm.

An alternative type of elastic material is a visco-elastic material for example a gel, suitably a polyurethane gel, for example the polyurethane gel materials disclosed in WO-A-05013762, for example those available under the name Technogel™.

The bristles, preferably grouped in tufts, may be mounted on such an elastomer material pad in various ways.

In one way it may be possible to embed the ends of the bristles directly in the pad.

In another way mounting of bristles into an elastomer material pad may be achieved by the use of plastics material, e.g. polypropylene, holders in which the tufts are retained e.g.

as disclosed in above-mentioned WO-A-97/20484, WO-A-98/35584, WO-A-98/43514, which can bind firmly with the elastomer material and which can retain the bristles in the pad. Each of such holders may retain an individual tuft of bristles or may retain plural tufts of bristles, so that the holder comprises a connecting part between the tufts of bristles. The holders may be connected together only by the elastomer material between then, so that the holders are isolated islands in the elastomer material pad.

In another way bristles in tufts may have their ends fused into a thickened mass and embedded in an elastomer bristle carrier, and pass, e.g. are threaded through plastics material rings embedded in the elastomer pad in the way disclosed in above-mentioned WO-A-04/020238 and for example as disclosed in applicant's pending European patent application EP 04010962.1 filed 7 May 2004, the contents of which are incorporated herein by reference. Such rings may be in the form of open-ended tubes which surround tufts of bristles which extend through them, and which are set in the elastomer material, and which allow movement of the tufts of bristles reciprocally along the bristle direction. The ends of the individual bristles of such tufts may be melted by heat so that they fuse together and then allowed to cool and solidify to form an enlarged mass, and this enlarged mass may be embedded in the elastomer material. Techniques to fuse the ends of toothbrush bristle tufts are known in the art.

Another way of mounting tufts of bristles in such an elastomer material pad is, or is analogous to, the method disclosed in WO-A-00/60980. In this latter disclosure at least some of the bristles are linked together at their ends proximate to the head by a web which is incorporated into the pad of resilient elastomer material. In such a construction the ends of the bristles or tufts may be attached to the web. Such a web typically comprises a flexible substantially 2-dimensional structure linking the ends of the bristles or tufts. There may be a single web linking all of the tufts or bristles, or a plurality of separate webs each respectively linking independent groups of tufts of bristles. For example the web may comprise a thin, flexible sheet, lattice, network or mesh of a material to which the ends of the bristles are attached. Alternatively the web may be made integrally of the same material as the bristles.

In an alternative embodiment the flexible bristle carrier may comprise plural plastics material segments which are flexibly linked so as to allow the carrier to be flexible such that it can deform under the forces of toothbrushing so that both its longitudinal and widthways sections become distorted. There may be two or more segments. To achieve deformation under the forces of toothbrushing so that its longitudinal section becomes distorted such segments may be sequentially longitudinally arranged. To achieve deformation under the forces of toothbrushing so that its widthways section becomes distorted such segments may be sequentially widthways arranged. Suitably such a carrier may comprise both segments sequentially longitudinally arranged and segments sequentially widthways arranged. The carrier may for example be divided both along and widthways across its longitudinal direction by flexible links, thereby allowing both its longitudinal and widthways sections to flex under these forces.

Each flexible link between segments may comprise a flexible plastics material bridge which is thinner than the thickness of the segments it links, or may comprise a composite structure of a combination of a flexible plastics material bridge which is thinner than the thickness of the segments it links and an elastomer material, e.g. with the bridge surrounded on one or more side by the elastomer material, e.g. embedded in the elastomer material, or the flexible link may be composed wholly of an elastomer material between the segments it links. It is preferred that such links are constructed to allow the carrier to stretch in its longitudinal direction under longitudinal tension.

In such a head comprising plural plastics material segments the bristles or tufts may be mounted into the segments in a manner as conventionally used in known toothbrushes with heads comprising plural flexibly linked segments.

The carrier, e.g. the elastomer material pad or the segmented carrier typically has a bristle surface and an opposite surface, the "back face", distant from the bristle face in a thickness direction transverse to the longitudinal direction. There is an edge surface between the bristle surface and the back surface. Such a pad may have flat bristle and back faces and be of uniform thickness, alternatively one or both of the bristle and/or back surfaces may be profiled e.g. with widthways aligned ridges or grooves to concentrate flexibility in pre-determined directions.

The support supports the carrier at a base part adjacent to the base end and at a tip part adjacent to the tip end, leaving the carrier unsupported thereby longitudinally in a region between these parts. Longitudinally between the base and tip parts the support may arch away from the back face of the carrier in a direction perpendicular to the longitudinal direction, in a curved or angular arched shape, e.g. so that the carrier extends in a chord direction between the cusps of the arch. In such a construction a space is left between the back face of the carrier and the support into which the carrier can deform. Typically the length of the unsupported region of the pad may comprise 50% or more, preferably 75% or more of the overall length between the extreme longitudinal ends of the pattern of bristles on the carrier. For example up to ca. 25% of the length of the pad immediately adjacent to the tip end and up to ca. 25% of the length of the pad immediately adjacent to the base end may be supported by the support. In this construction the side surface of the carrier longitudinally between the supported parts of the carrier may be left unsupported. Typically the pattern of bristles on a toothbrush head has a length ca. 20-30 mm. The space left between the back face of the carrier and the support may have a dimension 0.5-7 mm in the direction perpendicular to the longitudinal direction, e.g. 4+/−1 mm.

It is preferred that the support is flexible, e.g. capable of resilient bending deformation in its longitudinal direction, e.g. so that under the forces encountered in toothbrushing the tip part of the carrier can move resiliently to follow an arc in a plane perpendicular to the width direction, and/or capable of resilient twisting deformation about a generally longitudinal twist axis. The said plane perpendicular to the width direction may be a plane parallel to the longitudinal direction and to the direction in which the bristles extend from the bristle face. A flexible support having such modes of deformation assists the flexible deformation of the bristle carrier. Bending deformation of the support in its longitudinal direction can compress the carrier longitudinally to cause the bristle face of the carrier to shorten so that the bristles are closer together and denser packed, and can cause the bristle face of the carrier to adopt a longitudinally concave shape. Bending deformation of the support in its longitudinal direction can alternatively stretch the carrier longitudinally to lengthen the bristle face, or cause the bristle face of the carrier to adopt a longitudinally convex shape with splayed bristles. Twisting deformation of the support about a generally longitudinal twist axis can help the bristle face of the carrier to adapt more readily to the shape of the user's teeth and gaps between the teeth.

A flexible support may be achieved by a support comprising longitudinally distanced support parts to respectively support the base part and tip part of the carrier, integrally longitudinally linked by one or more flexible plastics material link. The support parts may be adapted to support the carrier, e.g. may comprise a cavity in which the carrier may fit, and may be provided with engagement features to enhance bonding between the carrier and support. The one or more link may define an arched shape of the support, i.e. close to, suitably in contact with, the carrier at opposed longitudinal ends of the support, but relatively distanced from the back surface of the carrier in a direction perpendicular to the longitudinal direction of the toothbrush, at a longitudinally intermediate position between these longitudinally opposite ends. Such a link may be in the form of a thin plastics material rib extending generally longitudinally. For example plural, suitably two, links may be disposed on widthways opposite sides of the central longitudinal axis of the head and may converge in the handle-toward-head direction, e.g. being in a generally "V" shape pointing away from the handle, or a generally "Y" shape with the stem pointing away from the handle.

However when the carrier comprises the above-mentioned visco-elastic material for example a gel, suitably a polyurethane gel, for example the polyurethane gel materials disclosed in WO-A-05013762, the support may be rigid, i.e. non flexible as described above.

Therefore in a further aspect of this invention is provided a toothbrush head, connected to or connectable to a toothbrush grip handle, having bristles projecting therefrom in a bristle direction, each bristle having an end proximate to the head and an end distanced from the head, the head incorporating a mass of a gel material or a mass of a polyurethane material, preferably a polyurethane gel material, and at least a part of a bristle adjacent its end proximate to the head being embedded in the mass of gel material, comprising a frame of a hard plastics material by which the mass is supported, wherein the mass, preferably in the form of a pad having a bristle surface, is supported by the frame at a support point adjacent to the tip end and at a support point adjacent to the base end, but is unsupported longitudinally between these two longitudinally spaced support points.

The support, i.e. the support parts, link(s) etc. may be made of a plastics material as commonly used in toothbrush manufacture, e.g. polypropylene ("PP"), polyamide ("PA"), acrylonitril butadiene styrene ("ABS") etc. and may be integrally made with the toothbrush handle. Support parts made of such materials may easily be made thin enough to be flexible as described.

Other parts of the toothbrush for example the toothbrush handle may be of generally conventional construction. For example the handle may incorporate one or more "S" bends as disclosed in EP-A-0 336 641. Additionally or alternatively the toothbrush may incorporate flexible links at other places in its structure, for example between its head and the immediately adjacent part of its handle, i.e. its neck, e.g. as disclosed in WO-A-92/17092 or WO-A-97/24949.

It is well known in the art of making toothbrushes how to connect a bristle carrier as described to a support made of the above-described plastics materials.

For example the toothbrush head, and the entire toothbrush of this invention may be made by generally known two-component injection moulding processes in which firstly the plastics material part(s) of the toothbrush are made, then the so-formed plastics material part is enclosed in a second mould cavity and an elastomer material is injected into the mould cavity and caused to bond with the plastics material in a known manner. Bristles may be set in the carrier in a generally known process, e.g. as disclosed in above-mentioned WO-A-04/080238. For example a tuft of bristles may be provided threaded through a ring of a plastics material which binds to the elastomer material (which may be the same plastics material as other parts of the toothbrush) with the end of the tuft to be set in the head fused together to form an enlarged mass, this end may be introduced into a mould cavity and the elastomer material injected therein to bind the plastics material.

For example above-mentioned WO-A-05013762 discloses methods by which a gel, e.g. polyurethane gel, may be connected to a support e.g. a frame.

It is found that the elastomer materials e.g. thermoplastic elastomer materials, the described gel and polyurethane materials mentioned above, particularly polyurethane gels such as the Technogel™ polyurethane gel materials bind well to the plastics materials commonly used for toothbrush manufacture, in particular PA and ABS.

The support e.g. a frame and the bristle carrier e.g. the elastomer material pad or mass of gel or polyurethane material may be provided with respective engagement features to retain the carrier and support in secure physical engagement, and/or the carrier and support may be bonded e.g. by a weld, adhesive or adherence between the frame and the mass. For example the support may comprise parts which are embedded in the elastomer material pad or mass of gel e.g. polyurethane material to enhance attachment between the elastomer material pad or mass of gel e.g. polyurethane material and the support. The support, e.g. a frame may additionally or alternatively be provided with one or more aperture passing through the support from one surface of the support to another surface of the support, through which the material of the carrier, e.g. the mass of gel or polyurethane passes from the one surface to the other surface to form a mushroom head at the other surface to thereby engage with the support.

The invention also provides a toothbrush, comprising a head as described herein, connected to a handle by which the toothbrush may be held during use. Such a toothbrush may be a manual toothbrush, or a power toothbrush e.g. in which the handle contains an electric power supply and an electric motor.

The invention will now be described by way of example only with reference to the accompanying drawings in which.

Figures 1, 2, 3:
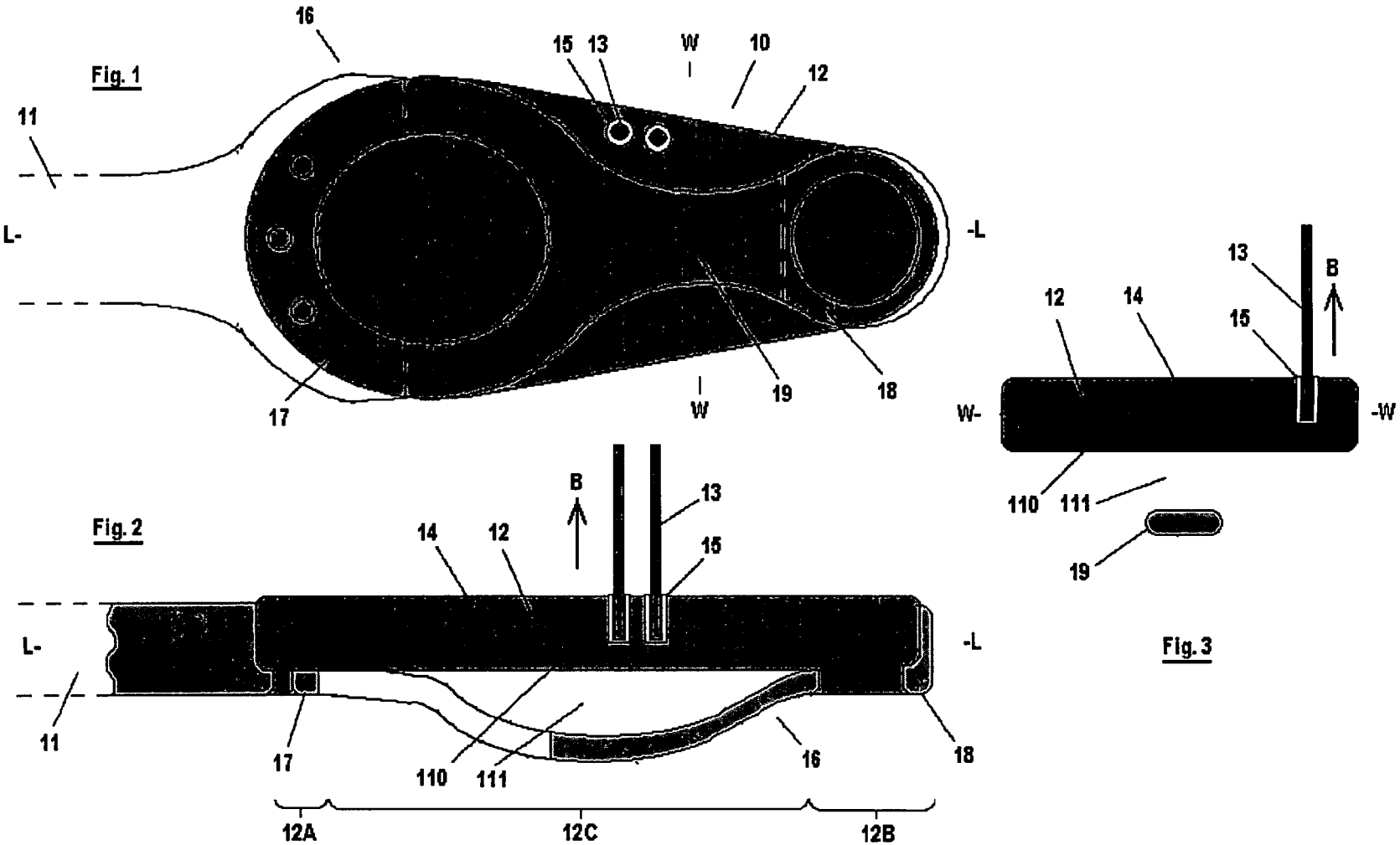
FIG. 1 shows a plan view of a toothbrush head of this invention.
FIG. 2 shows a longitudinal section through the toothbrush head of FIG. 1.
FIG. 3 shows a cross section through the toothbrush head of FIG. 1.

Referring to FIGS. 1, 2 and 3 the head 10 (overall) of a toothbrush of the invention is shown. The head 10 is connected to a toothbrush grip handle 11 of which only the part adjacent to the head 10 being shown, to define a head-handle longitudinal direction L-L and a perpendicular width direction W-W. For avoidance of doubt the length direction L-L Head 10 comprises a flexible bristle carrier 12 in which are mounted tufts 13 of plural bristles extending in bristle direction B only one of which is shown for clarity, but of which a plurality is disposed in a pattern over the bristle face 14 of the carrier 12 and from which the bristles 13 extend. The carrier 12 has a base part 12B closest to the toothbrush handle 11 and a longitudinally opposite tip part 12C.

Bristle carrier 12 comprises a pad of a thermoplastic elastomer material ("TPE") such as that available from Kraiburg Gummiwerk (DE) under the reference numbers RTF 8778, 8728, 8722 or 8725. The pad 12 has a thickness in the bristle direction B of ca. 3 mm.

Tufts 13 are mounted on the elastomer material pad 12 by the use of plastics material holders 15 in each of which the end of a tufts 13 is retained and which is set in the elastomer material of pad 12, binding therewith. The holders 15 are connected together only by the elastomer material between them, so that the holders 15 are isolated islands set in the elastomer material pad 12.

Alternatively the carrier 12 may comprise a pad, ca. 5 mm thick, of the material Technogel™, i.e. a polyurethane gel covered with a polyurethane coating available from the company Technogel Königsee, Gewerbegiet Alle Gärnerei, 37339 Berlingerode (DE), for example as the gel material BTG 120, in the form of polyurethane film coated sheets ca. 5 mm thick. Such a pad, with bristle tufts set directly therein, i.e. without the holders 15 may be made using an IMC process as disclosed in WO-A-0513762. Advantageously as disclosed in WO-A-0513762 when such a polyurethane material is used, the bristle material bonds well to the polyurethane so holders 15 are not needed.

Figure 4:
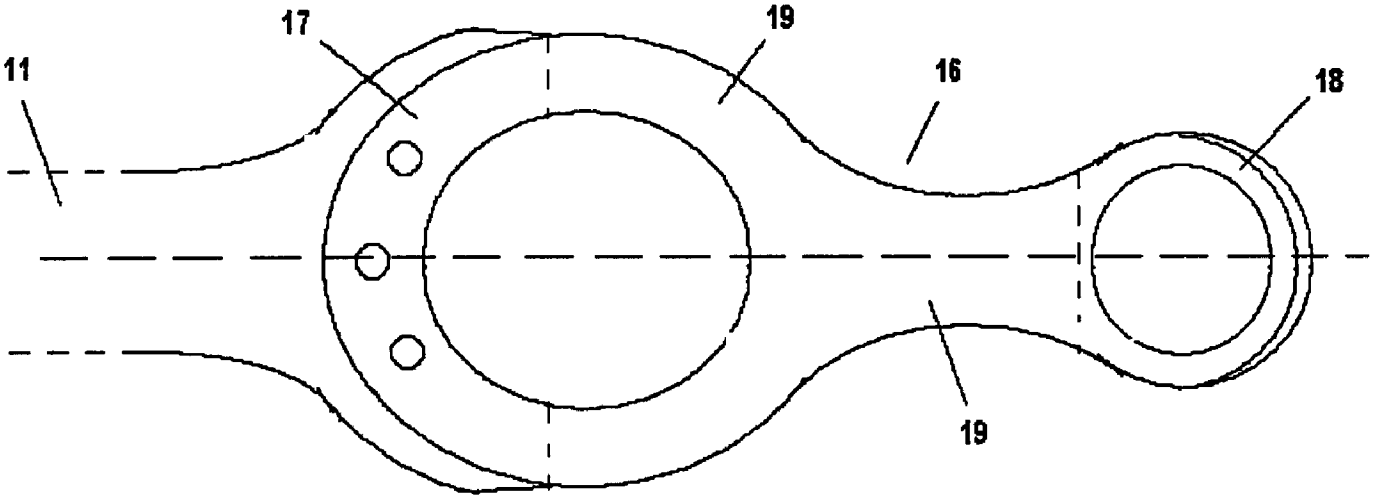
FIGS. 4 and 5 show the support used in the head of FIGS. 1, 2 and 3.
Figure 5:
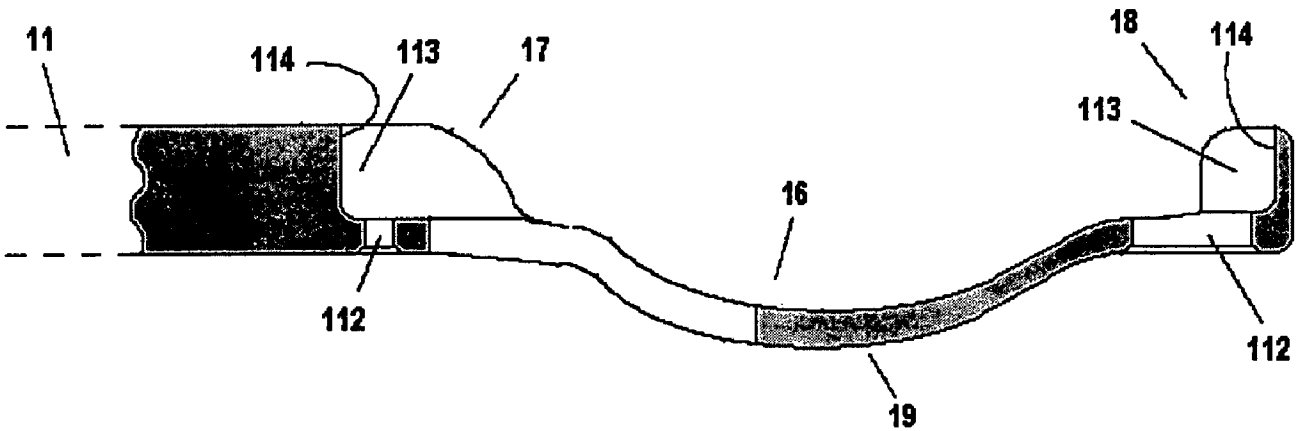

The carrier 12 is supported at its base part 12A and at its tip part 12B by a support 16, leaving the carrier 12 unsupported thereby in a region 12C longitudinally between these parts 12A, 12B. FIGS. 4 and 5 show the support 16 with the carrier 12 absent for clarity. The length of the unsupported region 12C of the pad 12 comprises some 75% or more of the overall length between the extreme longitudinal ends of the pattern of bristles 13 on the carrier. It is seen that up to ca. 25% of the length of the pad 12 immediately adjacent to the tip part 12B and up to ca. 25% of the length of the pad 12 immediately adjacent to the base part 12A are supported by the support 16. The support 16 comprises longitudinally distanced support parts 17, 18 to respectively support the base part 12A and tip part 12B of the carrier 12, integrally longitudinally linked by a flexible plastics material link 19 (overall) in the form of thin plastics material ribs 19 extending generally longitudinally.

The support 16 and handle 11 are integrally made of a plastics material (e.g. polypropylene ("PP"), polyamide ("PA"), acrylonitril butadiene styrene ("ABS") etc. as commonly used for the manufacture of toothbrushes.

Longitudinally between the base and tip parts 12A, 12B the support 16, i.e. the link 19 of the support 16 arches away from the back face 110 of the carrier 12 in a direction opposite to the bristle direction B. This leaves a space 111 ca. 4+/−1 mm wide between the back face 110 of the carrier 12 and the link 19 part of the support 16 into which the carrier can deform under the influence of pressure on the bristles 13 during toothbrushing. This deformation of carrier 12 under the influence of pressure applied in the direction of the bold arrow is shown more clearly in FIG. 6. The side surfaces of the carrier 12 longitudinally between the supported parts 12A, 12B of the carrier 12 are left unsupported by the carrier, as is more clearly seen in the cross section FIG. 3. This lack of support allows the deformation of the carrier 12 as shown in FIG. 7 under the influence of pressure at the point indicated by the bold arrow, which may occur simultaneously with the deformation shown in FIG. 6 so that the bristle face 14 can deform 3-dimensionally to adjust the bristles 13 to the curved surface of the teeth.

Figure 6:
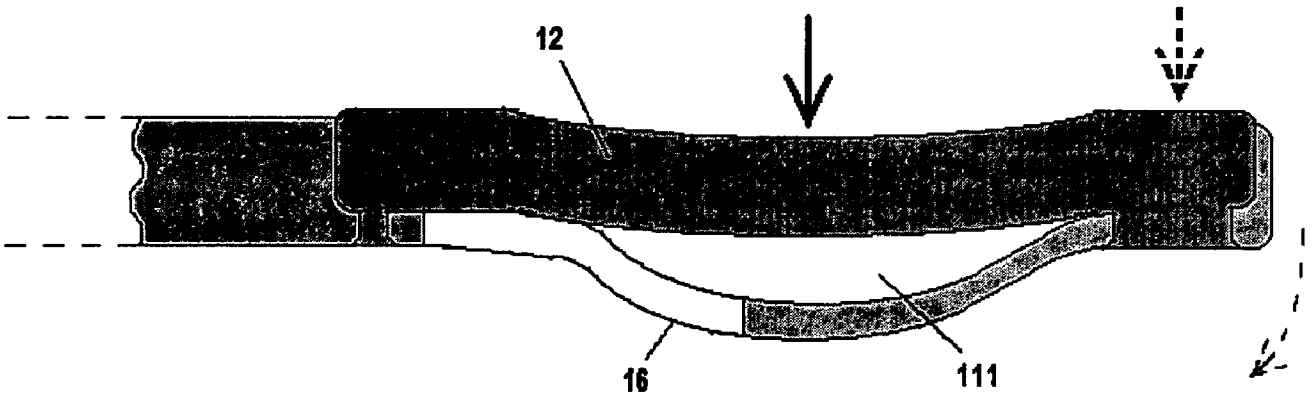
FIGS. 6, 7 and 8 show deformation of the head of FIGS. 1 to 5.
Figure 8:
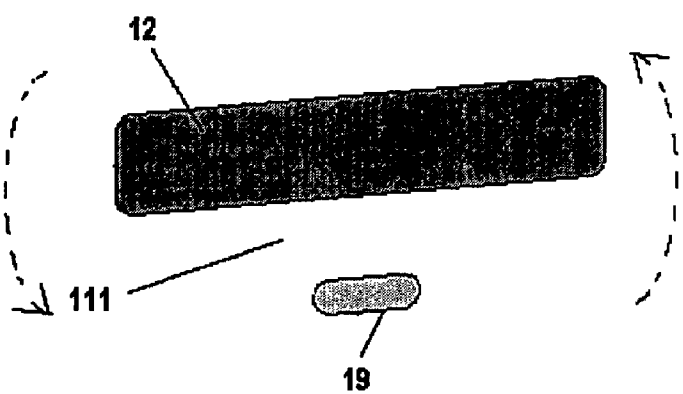
Figure 7:
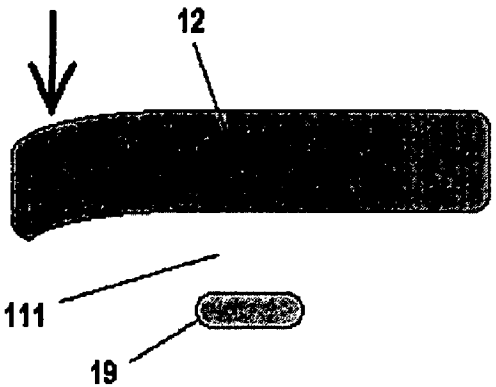

The support 16, in particular the link 19, is flexible, being capable of resilient bending deformation in its longitudinal direction, i.e. of bending about a bend axis parallel to the width direction W-W so that the support part 18 can follow an arc lying in the plane of the paper of FIG. 6. In such deformation the frame 16 may bend into a more tightly curved arch shape to thereby compress the carrier 12, or flatten into a less tightly arched shape to stretch carrier 12. FIG. 6 also shows how downward pressure acting on the tip part 18 of the head as shown by the bold dashed arrow can cause the support 16 to bend relative to parts of the support 16 closer to handle 11, about a bend axis parallel to the width direction W-W, so that the tip part moves downwards in the direction of the light dashed arrow shown. Pressure in the opposite direction causes an opposite bending deformation. FIG. 8 shows resilient twisting deformation of the link 19 about a twist axis generally aligned with the longitudinal direction L-L, accompanied by a twisting deformation of carrier 12.

The carrier 12 is bonded to the parts 17, 18 by bonding of known type between the plastic material of the support 16 and the thermoplastic material of the support 16. However support parts 17, 18 are also shown provided with engagement holes 112 which are wider at the outer surface of the support 16, so that the material of the pad 12 passes through these holes 112 to form a "mushroom head" at the outer surface so that the material of the pad 12 engages with the support 16. The support parts 17, 18 are also defined cavities 113 in which the pad 12 sits, the sides 114 of the cavities 113 providing an area for bonding between the elastomer material of the pad 12 and plastics material. The support parts 17, 18 may be provided with additional or alternative structural features (not shown) to enhance engagement and/or bonding between the pad 16 and support parts 17, 18.

Figures 9, 10, 11:
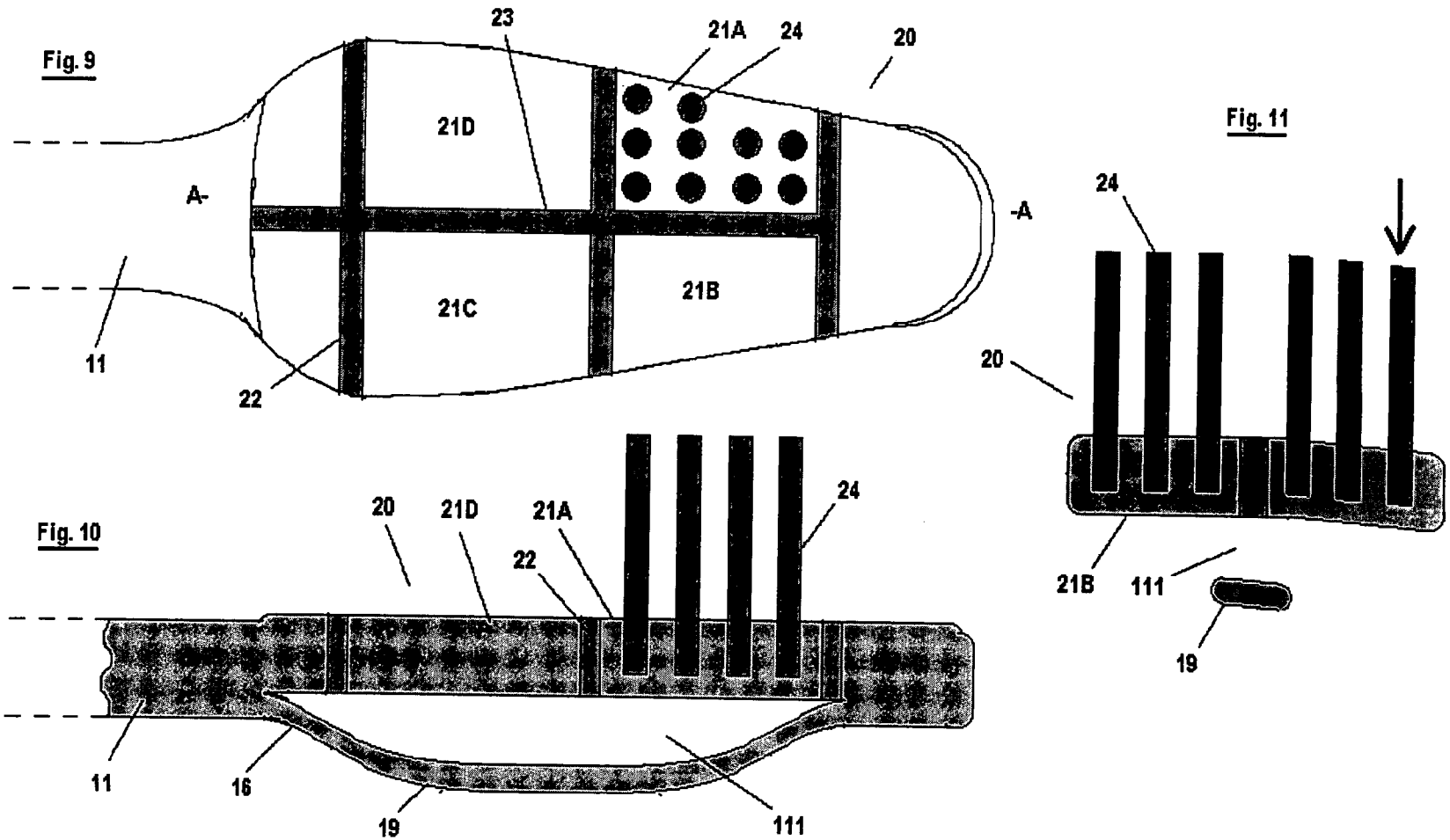
FIGS. 9, 10 and 11 show an alternative construction of toothbrush head of this invention.

Referring to FIGS. 9, 10 and 11, views analogous to FIGS. 1, 2 and 3 are shown of a toothbrush head 20, FIG. 10 showing a longitudinal section cut along line A-A, corresponding parts being numbered correspondingly. In this toothbrush however the flexible bristle carrier comprises plural plastics material segments 21A, 21B, 21C, 21D. The carrier is divided both along and widthways across their longitudinal direction by flexible links 22 aligned across head 20, and links 23 aligned longitudinally, and which comprise a filling of an elastomer material between the segments 21A, 21B, 21C, 21D, and which allow the carrier to be flexible such that it can deform under the forces of toothbrushing so that both its longitudinal and widthways section become distorted. The pairs of segments 21A, 21D and 21B, 21C are longitudinally disposed, and the pairs of segments 21A, 21B and 21C, 21D are widthways disposed. Although in these drawings only two segments are shown longitudinally disposed there may be three or more. Although in these drawings only two segments are shown widthways disposed there may be three or more. The flexible links 22 may each comprise a thin, flexible link of plastics material integral with and connecting adjacent segments 21A, 21B, 21C, 21D, and embedded in an elastomer material. Such links are otherwise known in toothbrush heads. Tufts of bristles 24 (only shown in segment 21A for clarity) are conventionally mounted. The support 16 comprises a link 19 which is flexible analogously to the link 19 of FIGS. 1-8 and can bend and twist analogously to that link to allow deformation of the carrier. In FIG. 11 deformation of the widthways section of the carrier 21 and twisting of the flexible link 19 is shown.

Figure 12:
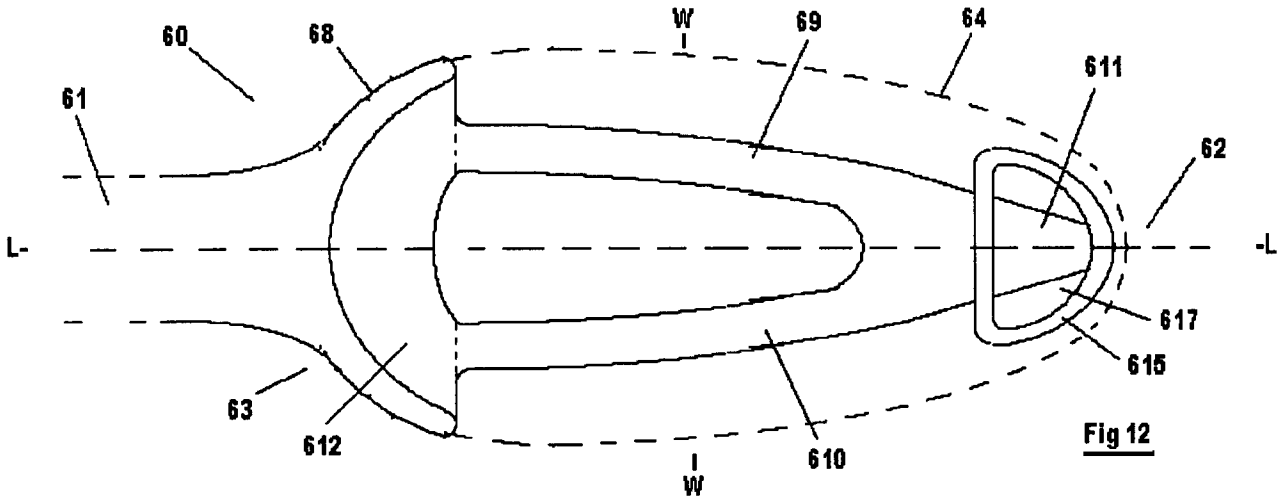
FIGS. 12 and 13 show another alternative construction of toothbrush head of this invention, FIG. 13 also showing an alternative way of fixing the toothbrush bristles into the toothbrush head.
Figure 13:
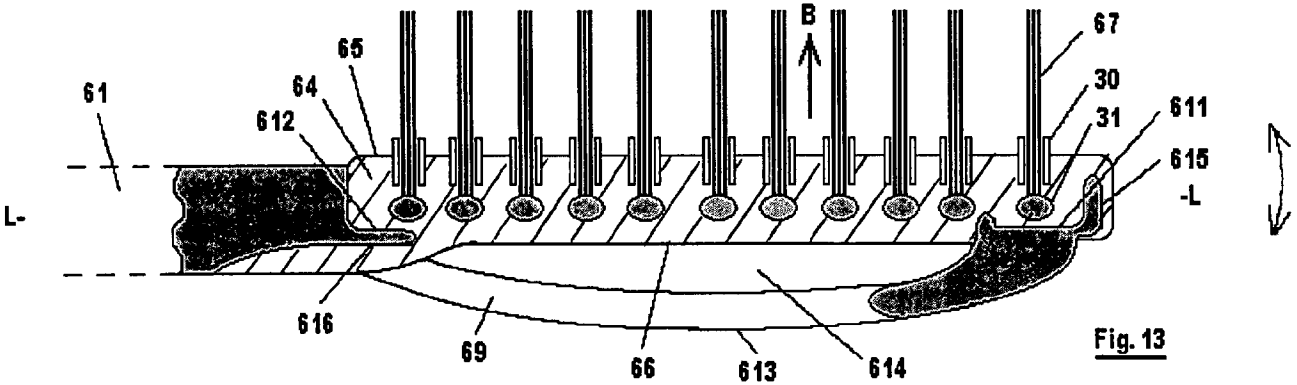

Referring to FIGS. 12 and 13 an alternative form of toothbrush head 60 in views analogous to FIGS. 1 and 2. In FIG. 12 the bristle carrier 64 is for clarity not fully shown, only the line of its edge being shown in dashed outline. FIG. 12 shows a plan view looking down toward the bristle face, and FIG. 13 shows a longitudinal sectioned view about the longitudinal line L-L of FIG. 12 looking in the widthways direction W-W seen in FIG. 12. FIGS. 12 and 13 show the toothbrush head 60, and part of the grip handle 61 immediately adjacent to the head 60. The head 60 and handle 61 are disposed along a head-handle longitudinal direction L-L. The head 60 is elongate in line with this longitudinal direction, and has a tip end 62 longitudinally remote from the handle 61, and a longitudinally opposite base end 63 closest to the handle 61.

A pad of thermoplastic elastomer material 64 comprises a pad having a surface 65, the "bristle face" and having an opposite surface 66, the "back surface", distant from the bristle face 65 in a direction, the "thickness direction", transverse to the longitudinal direction L-L. There is an edge surface (not shown) between the bristle face 65 and the back surface 66. Surface 65 is generally in a plane parallel to the longitudinal direction L-L of the head 60. Bristles 67 seen in FIG. 13 extend from this bristle face 65 in a bristle direction perpendicular to the longitudinal direction L-L.

The head 60 comprises a frame 68 integrally made with handle 61 of plastics material such as polypropylene. As seen in plan view in FIG. 12 the frame is approximately "V" shaped with two thin resiliently flexible links 69, 610 symmetrically on widthways opposite sides of the longitudinal direction L-L, the "V" pointing toward the tip end of the head. Frame 68 supports pad 64 at a support point 611 adjacent to the tip end 62 and at a support point 612 adjacent to the base end 63 of similar construction to those shown in FIGS. 1 and 2.

A part 613 of each of the links 69, 610 longitudinally between support points 611, 612 arches away in a direction perpendicular to the longitudinal direction L-L from the back surface 66 of the pad 64 in a direction opposite to the bristle direction, to leave a void 614 between the back surface 66 and the part 613 of frame 68. It is seen in FIGS. 12 and 13 that ca. 25% of the length of the pad 64 immediately adjacent to the tip end 62 and the base end 63 is supported by the frame 68. As seen in FIG. 13 between these supported parts, i.e. adjacent the part 613, the pad 64 is unsupported.

Figure 15:
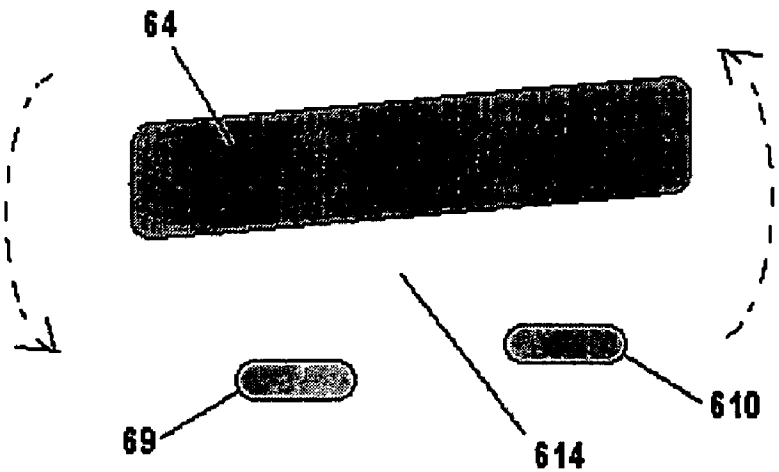
FIGS. 14 and 15 show flexibility of the head of FIGS. 12 and 13.
Figure 14:
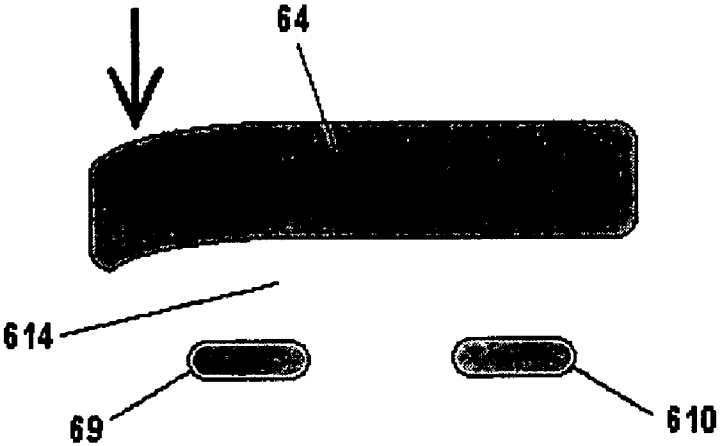

The links 69, 610 are resiliently flexible so that under the forces of toothbrushing the frame 68 can distort, e.g. so that the support part 69 can move in an arc lying in the plane of the paper of FIG. 13 e.g. as indicated by the arrow, and/or can twist about a twist axis parallel to the longitudinal direction L-L. FIGS. 14 and 15 are cross sections through the head 60 of FIGS. 12 and 13 and show resilient flexible deformation of the pad 64 under the forces encountered in toothbrushing. In FIG. 15 the resilient flexible deformation of the two links 69, 610 as part twists about a twist axis generally parallel to the longitudinal direction L-L is shown.

Support points 611 and 612 comprise respective parts 615 and 616 which are embedded in the elastomer material pad 64 to enhance attachment of the pad 64 and frame 68, part 615 having apertures 617 through which the elastomer passes.

Referring to FIG. 13 an alternative way of setting the tufts of bristles 67 in the TPE pad 64 is shown. Cylindrical tubular rings 30 made of a plastics material e.g. the same material as handle 61 and support 68 have one end embedded in pad 64, with their cylindrical axis perpendicular to surface 65, and an opposite end projecting from this surface. These rings 30 surround tufts of bristles 67 which extend through them and which have their ends fused to form an enlargement 31 and set in the elastomer material of pad 64. This construction allows movement of the tufts of bristles 67 reciprocally along the bristle direction, slidingly moving within the rings 30. Such a way of setting the bristles 67 is disclosed in applicant's pending European patent application EP 04010962.1 filed 7 May 2004. A process by which such rings 30 may made embedded in such a pad 64 is disclosed in WO-A-04080238.

The invention claimed is:

1. A toothbrush head, connected to or connectable to a toothbrush grip handle to define a head-handle length direction with a width direction perpendicular to the longitudinal direction, the head having a width and a central longitudinal axis, comprising a flexible bristle carrier which comprises a pad of an elastic material on which bristles are mounted with their ends embedded in the elastic material and having a base part closest to the toothbrush handle when connected, and a longitudinally opposite tip part, and a support which supports the carrier, the support comprising at least one plastic material rib disposed generally longitudinally, the rib having a width that is narrower than the width of the head;

wherein the support supports the carrier at the base part and at the tip part, leaving the carrier unsupported thereby in a region longitudinally between these parts, the carrier being flexible such that under the forces of toothbrushing it can deform so that both its longitudinal and widthways sections become distorted and the at least one rib is capable of resilient bending deformation so that under the forces encountered in toothbrushing the tip part of the carrier can move resiliently to follow an arc in a plane perpendicular to the width direction; and the support can perform resilient twisting deformation about a generally longitudinal twist axis.

2. A toothbrush head according to claim 1, wherein longitudinally between the base and tip parts the support arches away from the back face of the carrier in a direction perpendicular to the longitudinal direction, in a curved or angular arched shape.

3. A toothbrush head according to claim 1, wherein the side surface of the carrier longitudinally between the supported parts of the carrier is unsupported by the support.

4. A toothbrush head according to claim 1, wherein the flexible support comprises longitudinally distanced support parts to respectively support the base part and tip part of the carrier, integrally longitudinally linked by the at least one plastic material rib.

5. A toothbrush head according to claim 4 characterised by plural ribs disposed on widthways opposite sides of the central longitudinal axis of the head.

6. A toothbrush head according to claim 5 characterised by two ribs which converge in the handle-toward-head direction.

7. A toothbrush head according to claim 1, wherein the elastic material is an elastomer material.

8. A toothbrush head according to claim 7, wherein the bristles are disposed in tufts and are fixed into the elastomer pad with their ends fused into a thickened mass and embedded in the elastomer pad, and pass through plastics material rings embedded in the elastomer pad.

9. A toothbrush head according to claim 8, wherein said rings are in the form of open-ended tubes which surround tufts of bristles which extend through them, and which are set in the elastomer material and which allow movement of the tufts of bristles reciprocally along the bristle direction.

10. A toothbrush head according to claim 1, wherein the elastic material is a visco-elastic polyurethane gel material.

11. A toothbrush head according to claim 1 characterised in that the bristle carrier comprises plural plastics material segments which are flexibly linked so as to allow the carrier to be flexible such that it can deform under the forces of toothbrushing so that both its longitudinal and widthways sections become distorted.

12. A toothbrush head according to claim 11 characterised in that the carrier comprises segments which are sequentially longitudinally arranged.

13. A toothbrush head according to claim 11 characterised in that the carrier comprises segments which are sequentially longitudinally arranged and sequentially widthways arranged.

14. A toothbrush having a head according to claim 1, connected to a handle by which the toothbrush may be held during use.

15. The toothbrush head of claim 1, wherein the support comprises two plastic material ribs disposed along and on opposite sides of the central longitudinal axis and converging in the handle toward the head direction.

16. A toothbrush head, connected to or connectable to a toothbrush grip handle, having a width and bristles projecting therefrom in a bristle direction, each bristle having an end proximate to the head and an end distanced from the head, the head incorporating a mass of a visco-elastic polyurethane gel material, and at least a part of the bristles adjacent their end proximate to the head being embedded in and bonded with the mass of polyurethane gel material, comprising a frame of a hard plastics material by which the mass is supported, wherein the mass of polyurethane gel material is in the form of a pad having a tip part distal from the grip handle and a base part proximal to the grip handle and having a bristle surface, is supported by the frame at a support adjacent to the tip part and at a support point adjacent to the base part, but is unsupported longitudinally between these two longitudinally spaced support points, wherein the support comprises at least one plastic material rib disposed generally longitudinally, the rib having a width that is narrower than the width of the head.

* * * * *